US005806406A

United States Patent [19]

Pettersson

[11] Patent Number: 5,806,406

[45] Date of Patent: Sep. 15, 1998

[54] HYDRAULIC PISTON CYLINDER

[75] Inventor: Thomas Pettersson, Trollhättan, Sweden

[73] Assignee: AB Multidock Hydraulic, Askim, Sweden

[21] Appl. No.: 750,891

[22] PCT Filed: Jun. 14, 1995

[86] PCT No.: PCT/SE95/00717

§ 371 Date: Dec. 13, 1996

§ 102(e) Date: Dec. 13, 1996

[87] PCT Pub. No.: WO95/34759

PCT Pub. Date: Dec. 21, 1995

[30] Foreign Application Priority Data

Jun. 15, 1994 [SE] Sweden ..... 9402096

[51] Int. Cl.[6] ..... F01B 31/00

[52] U.S. Cl. ..... 92/164; 92/128; 92/165 R; 92/168

[58] Field of Search ..... 92/128, 163, 164, 92/165 R, 168

[56] References Cited

U.S. PATENT DOCUMENTS

| | | | |
|---|---|---|---|
| 2,414,492 | 1/1947 | Urschel et al. | 92/164 |
| 2,518,787 | 8/1950 | Huhtala | 92/164 |
| 2,719,766 | 10/1955 | Densmore | 92/164 |
| 2,953,118 | 9/1960 | Flick et al. | 92/163 |
| 3,113,490 | 12/1963 | Weaver | 92/163 |
| 3,185,043 | 5/1965 | Dunham | 92/164 |
| 3,685,398 | 8/1972 | Little . | |
| 3,898,915 | 8/1975 | Neuman . | |
| 4,207,807 | 6/1980 | Takata et al. . | |
| 4,671,169 | 6/1987 | Hillier | 92/128 |
| 5,471,909 | 12/1995 | Kobelt | 92/164 |

FOREIGN PATENT DOCUMENTS

| | | | |
|---|---|---|---|
| 2156623 | 5/1973 | Germany . | |
| 562073 | 6/1944 | United Kingdom | 92/164 |

*Primary Examiner*—Thomas E. Denion
*Attorney, Agent, or Firm*—Oppedahl & Larson

[57] ABSTRACT

A hydraulic cylinder, comprising a cylindric tube (10) with two end covers (11, 12). One of the end covers (11) is provided with an opening for a piston rod (13) connected to a piston (14) which is displaceable between the end covers. The end covers (11, 12) are on one hand connected to the tube (10) via a screw joint (15, 16), on the other are provided with channels (18) for inlet and outlet of a hydraulic medium, to and from the respective spaces between the piston (14) and the end covers (11, 12). Each end cover (11, 12) comprises an outer member (19, 20) and an insert member (21, 22). The channels (18) for the hydraulic medium extend through the outer member (19, 20) and the insert member (21, 22).

7 Claims, 2 Drawing Sheets

HYDRAULIC PISTON CYLINDER

TECHNICAL FIELD

The present invention relates to a hydraulic cylinder, comprising a cylindric tube with two end covers, of which one end cover is provided with an opening for a piston rod connected to a piston which is displaceable between the end covers, wherein the end covers on one hand are connected to the tube via a screw joint, on the other are provided with channels for inlet and outlet of a hydraulic medium, to and from the respective spaces between the piston and the end covers.

BACKGROUND OF THE INVENTION

Hydraulic cylinders according to the above are used as components in many different machines and vehicles, in order to create and control movements.

The cylinders are rather simple to make in serial production in different special variants with reference to diameter and stroke, according to customer's needs. Thereby, a series produced machine or a vehicle may be optimized with reference to the intended area of use.

At later stages, during the service life of the machine or the vehicle, a hydraulic cylinder may be damaged so that it has to be replaced. Then it is often impossible to obtain a hydraulic cylinder as a stock item, but it has to be specially made comparatively expensive. The manufacturing will be expensive, because a number of welds usually must be made when assembling the two end covers of the cylinder tube, when assembling the cylinder tube connectors for hydraulic lines and when mounting the brackets of the piston rod and the tube. This welding also give rise to known disadvantages, e.g. changes in the material and thermal tensions.

Certainly, there are hydraulic cylinders, which are assembled by means of tension rods. However, those hydraulic cylinders will require more space for installation, which often prevents them from replacing conventional welded hydraulic cylinders. Also, they are more heavy.

One object of the present invention is therefore to provide a hydraulic cylinder which may replace welded cylinders and may be specially made in a more simple manner than those cylinders.

SUMMARY OF THE INVENTION

For this purpose, the apparatus according to the invention is characterized in that each end cover comprises an outer member and an insert member, and that the channels for the hydraulic medium extend through the outer member and the insert member. By this design of the end covers, the work is reduced when assembling special cylinders, substantially when adapting the cylinder tube and the piston rod to the correct stroke.

BRIEF DESCRIPTION OF THE DRAWINGS

The invention will be described here below with reference to an embodiment shown in the accompanying drawings, in which.

DETAILED DESCRIPTION OF THE INVENTION

Figure 1:
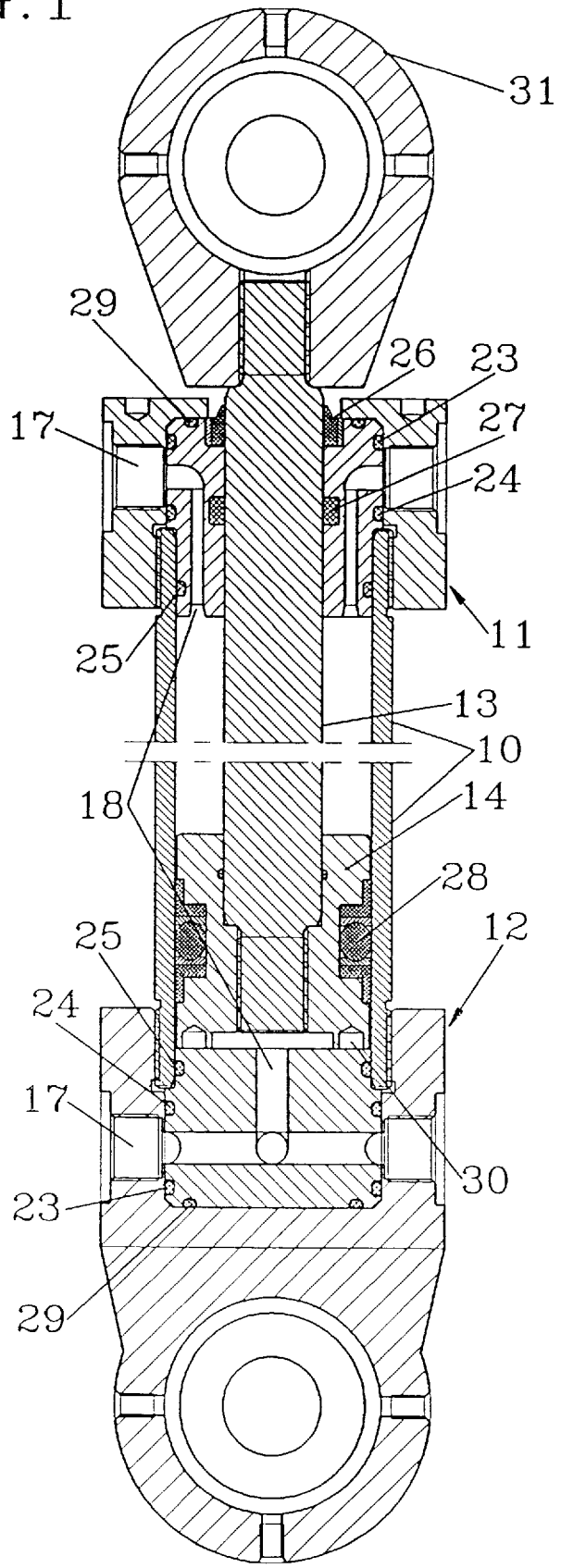
FIG. 1 shows a longitudinal section through a hydraulic cylinder according to the invention, FIG. 2 in a somewhat reduced scale shows one of the end covers with its piston rod and piston.
Figure 2:
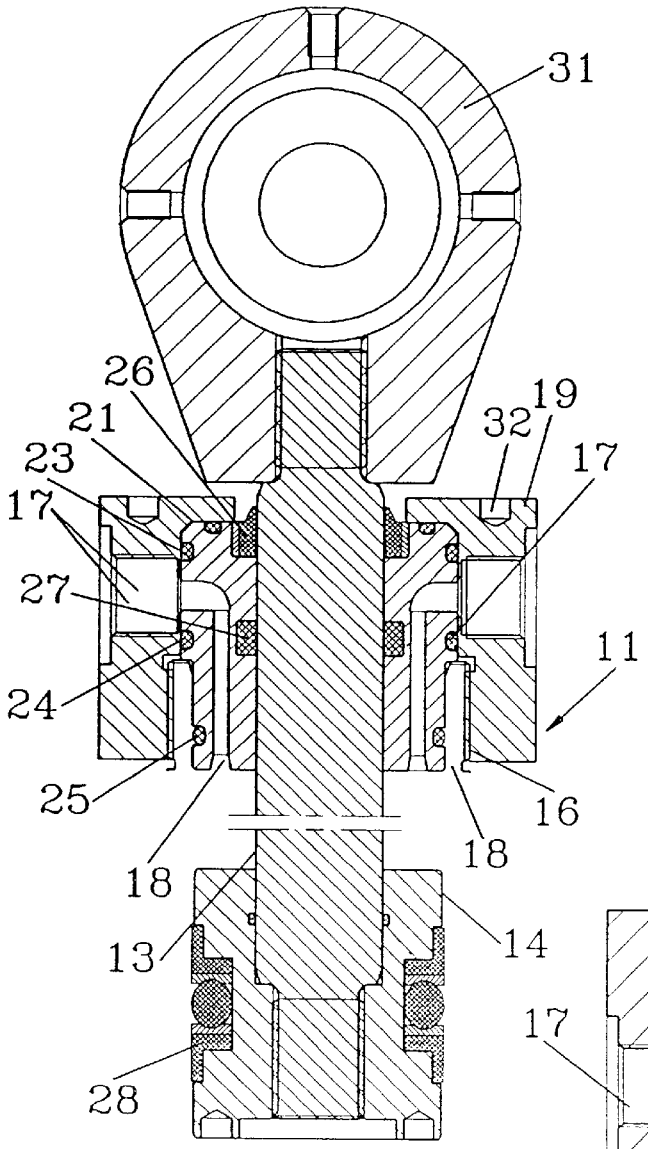
Figure 3:
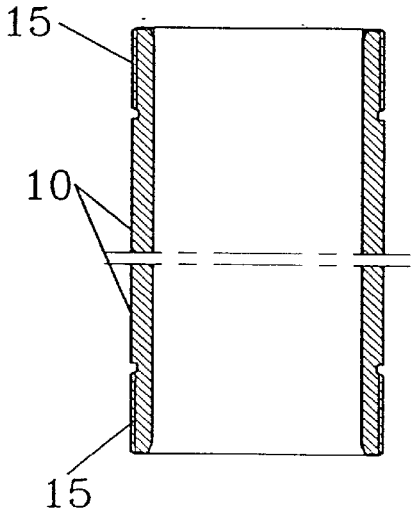
FIG. 3 shows the cylinder tube correspondingly.
Figure 4:
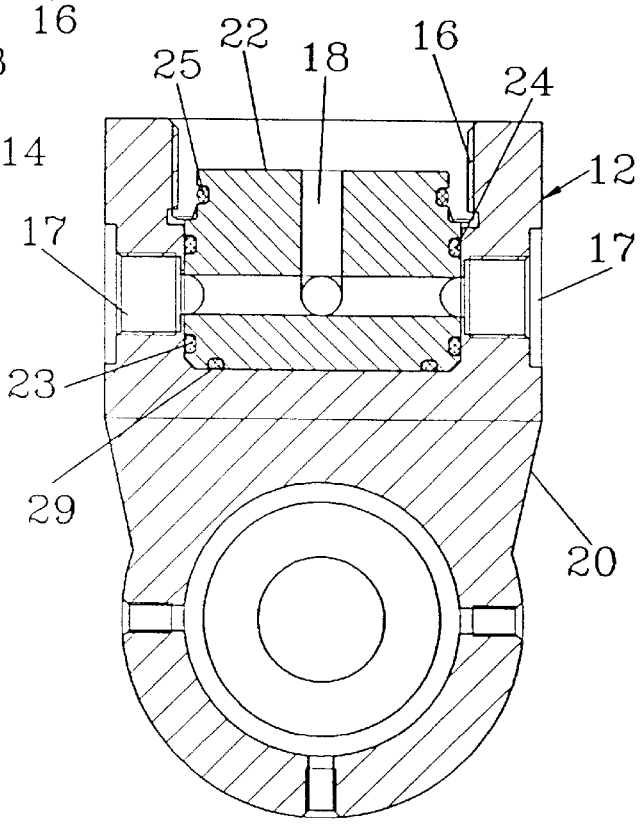
FIG. 4 shows the other end cover.

The hydraulic cylinder shown in the figures comprises a cylindrical tube 10 with end covers 11, 12. One of the end covers 11 is provided with an opening for a piston rod 13 which is connected to a piston 14 which is displaceable between the end covers. As shown in FIGS. 1 and 2, the opening for the piston rod 13 in the end cover 11 may have a diameter which is larger than the diameter of the piston rod.

The end covers 11, 12 are connected to the tube 10 via screw joints, comprising one at each of the outer members (19, 20) is provided (16) with a section of (15) at each end of the tube (10) each tube end is provided with an external screw thread 15, which is adapted for cooperation with an internal screw thread 16 at each of the end covers 11, 12.

Each end cover is provided with connectors 17 and internal channels 18 for inlet and outlet of a hydraulic medium, to and from the respective spaces between the piston 14 and the end covers.

Each end cover 11, 12 comprises an outer member 19, 20 and an insert member 21, 22. As shown most clearly in FIG. 1, the insert members 21, 22 are disposed at the ends of the cylindrical tube 10 and have an outer diameter which is larger than the inner diameter of the cylindrical tube 10. The connectors 17 for the hydraulic medium are located in the outer member 19. The channels 18 are composed partly by a ring-shaped groove extending around the two insert members 21, 22 and partly by an angular connection to the respective cylinder room. The insert members 21, 22 form supports at the inside of the two threaded sections 15 of the tube 10.

Each insert member is also provided with three grooves for external O-ring seals 23, 24, 25. The seal rings 23 and 24 form seals against the inside of the outer member at each side of the channel groove of the insert member. The remaining O-ring seal 25 seals towards the inside of the tube 10. Thus, the insert member extends for some distance at the inside of the two threaded end sections of the cylinder tube, acting as support for these sections.

The insert member 23 is also provided with the usual internal seals and wiper rings 26, 27 acting against the mantle surface of the piston rod. Correspondingly, the piston 14 is provided with conventional sealing means 28 acting against the inside of the cylinder tube 10. Also, the two insert members 19, 20 are provided with end cover seals 29, which provide adjustability longitudinally in the cylinder. This means that the hydraulic medium connectors 17 can be located exactly in line with each other without any of the screw joints having to be tightened until the end of the thread, so that uneven force distribution between the end covers and the tube is avoided.

This adjustability may be accomplished with other means than the end cover seals 29, e.g. with end stops in the form of adjustable screws.

The manufacturing and assembling of a hydraulic cylinder according to the invention is made in the following way: The end covers 11, 12, the piston 14, the piston rod 13 and the cylinder tube 10 are selected according to customer's specification. The piston rod and the cylinder tube are cut in length according to customer's specification. Then both ends of the piston rod and the cylinder tube are threaded with screw threads. The insert member 21 and the piston 14 with associated seals are mounted upon the piston rod 13. The outer member 19 is then entered onto the insert member 21, whereafter the piston is tightened onto the rod by means of the apertures 30 and the bracket eye 31.

The cylinder tube 10 is then entered onto the piston 14 and is screwed into the end cover 11. Finally, the end cover 12 is screwed onto the opposite end of the cylinder tube. The bracket eye of the end cover 12 and the apertures 32 are used for tightening to the required tightening torque. When tightened, both ends of the tube 10 abut against shoulders at the inside of the outer member and the inside of the insert member, at the bottom of the section having an internal thread. This provides a locking of the insert members 21, 22 between the tube ends and the respective outer member 19, 20. At the same time, the tube ends are positioned with reference to the end covers, so that the length of the hydraulic cylinder will be correct. Preferably, a thread locking fluid is used in all screw joints.

The invention is not limited to the above described embodiment, but several variants are conceivable within the scope of the accompanying claims. For example, the end covers do not have to comprise both an outer member and an insert member.

I claim:

1. A hydraulic cylinder, comprising a cylindric tube (10) with two end covers (11, 12), of which one end cover (11) is provided with an opening for a piston rod (13) connected to a piston (14) which is displaceable between the end covers, wherein the end covers (11, 12) on one hand are connected to the tube (10) via a screw joint (15, 16), on the other are provided with channels (18) for inlet and outlet of a hydraulic medium, to and from the respective spaces between the piston (14) and the end covers (11, 12), wherein each end cover (11, 12) comprises an outer member (19, 20) and an insert member (21, 22), and that the channels (18) for the hydraulic medium extend through the outer member (19, 20) and the insert member (21, 22).

2. A hydraulic cylinder according to claim 1, wherein each of the outer members (19, 20) is provided with an internal screw thread (16) for cooperation with a section of external screw thread (15) at each end of the tube (10).

3. A hydraulic cylinder according to claim 2, wherein the insert members (21, 22) provide support at the inside of the threaded sections (15) of the tubes.

4. A hydraulic cylinder comprising a cylindrical tube (10) with two end covers (11, 12), of which one end cover (11) is provided with an opening for a piston rod (13) connected to a piston (14) which is displaceable between the end covers, wherein each end cover (11, 12) is connected to the tube (10) via a screw joint (15, 16), and is provided with channels (18) for inlet and outlet of a hydraulic medium, to and from the respective spaces between the piston (14) and end covers (11, 12), and wherein i) each end cover (11, 12) comprises an outer member (19, 20) and an insert member (21, 22), ii) the channels (18) for the hydraulic medium extend through the outer member (19, 20) and the insert member (21, 22), iii) the insert members (21,22) are substantially cylindrical and have an outer diameter that is larger than the inner diameter of the tube (10), each of said insert members (21, 22) being integrated with the outer members (19, 20) to form sealing closures against said outer members (19, 20), and iv) the opening for the piston rod (13) has a diameter which is larger than the diameter of the piston rod (13).

5. A hydraulic cylinder according to claim 4, wherein each insert member (21, 22) is provided with grooves for external O-ring seals (23–25), of which at least one (25) is provided to seal against the inside of the tube (10).

6. A hydraulic cylinder according to claim 5, wherein additional O-ring seals (23, 24) are provided to seal against the inside of each outer member (19, 20).

7. A hydraulic cylinder comprising a cylindrical tube (10) with two end covers (11, 12) disposed at the proximal and distal ends of the cylinder, of which one end cover (11) is provided with an opening for a piston rod (13) connected to a piston (14) which is displaceable between the end covers, wherein each end cover (11, 12) is connected to the tube (10) via a screw joint (15, 16), and is provided with channels (18) for inlet and outlet of a hydraulic medium, to and from the respective spaces between the piston (14) and end covers (11, 12), and wherein i) each end cover (11, 12) comprises an outer member (19, 20) and an insert member (21, 22), ii) the channels (18) for the hydraulic medium extend through the outer member (19, 20) and the insert member (21, 22), and iii) the insert members (21, 22) are integrated with the outer members (19, 20) to form sealing closures against said outer members (19, 20) on both the distal and proximal sides of the channels 18.

* * * * *